United States Patent [19]

Comyns-Carr

[11] 4,109,798

[45] Aug. 29, 1978

[54] CRANE HAVING OVERLOAD RELEASE MEANS

[75] Inventor: Cecil Alastair Comyns-Carr, Lansdown, England

[73] Assignee: Stothert & Pitt Limited, England

[21] Appl. No.: 835,743

[22] Filed: Sep. 22, 1977

[30] Foreign Application Priority Data

Sep. 30, 1976 [GB] United Kingdom ..... 40621/76

[51] Int. Cl.[2] ..... B66C 13/48

[52] U.S. Cl. ..... 212/39 R; 212/58 R; 254/173 R

[58] Field of Search ..... 212/35 R, 35 HC, 39 R, 212/39 B, 39 MS, 58 R, 59 R, 59 A; 254/144, 173 R, 174

[56] References Cited

U.S. PATENT DOCUMENTS

| | | | |
|---|---|---|---|
| 2,013,690 | 9/1935 | Lamond | 212/39 A |
| 3,123,223 | 3/1964 | Markwardt et al. | 212/59 A |

*Primary Examiner*—Robert G. Sheridan

[57] ABSTRACT

A crane having a hoist winch with a hoist cable connected to a link which parts at a predetermined tension, and a jib over which the hoist cable is reeved for connection to a load. A derricking system on the crane includes a derricking winch and a derricking cable for luffing the jib. It also includes an hydraulic ram connected to one or more preloaded hydropneumatic accumulators in which the gas pressure is set to cause the ram to react against a predetermined overload. The hoist winch is released by mechanism responsive to movement of the ram, due to exceeding said predetermined overload, so that the hoist winch, when released, pays out the hoist cable to enable parting of the link.

6 Claims, 8 Drawing Figures

CRANE HAVING OVERLOAD RELEASE MEANS

Figure 1:
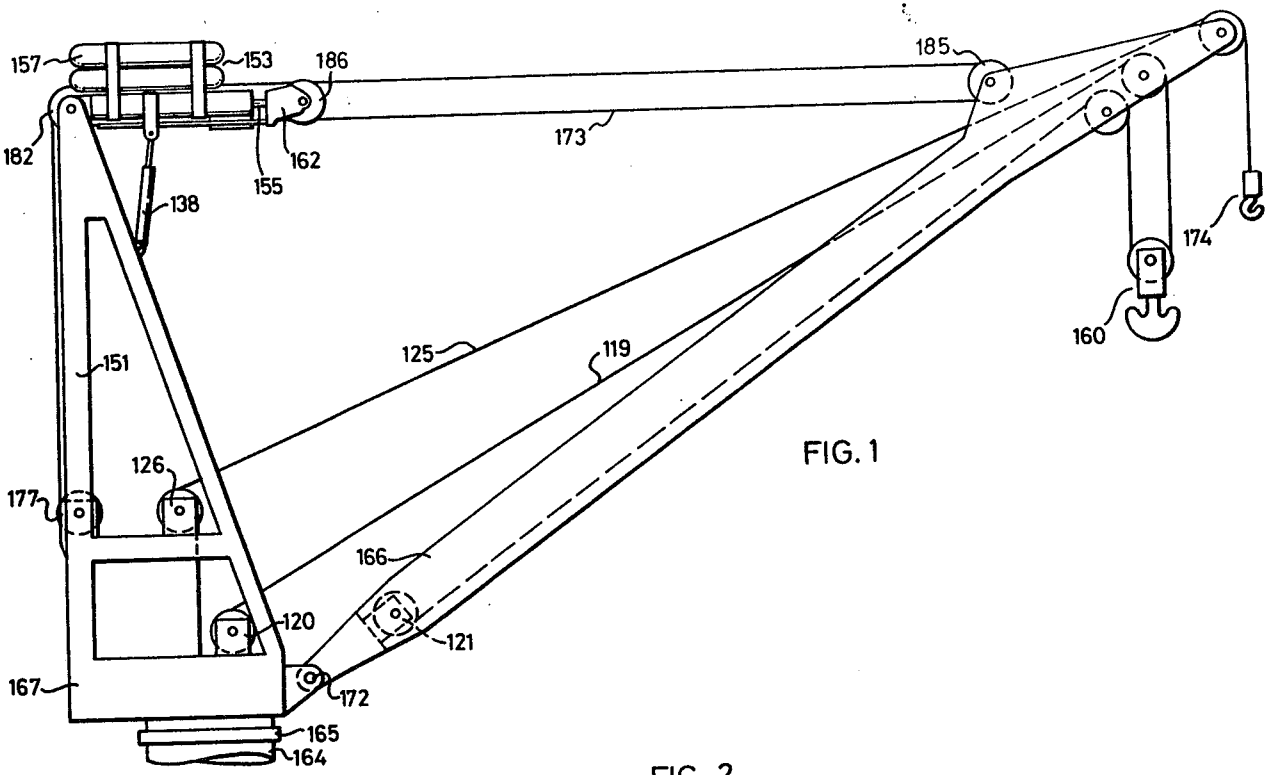

This invention relates to cranes and more particularly to a crane including a luffing jib and a safety device to ensure that the bending moment transmitted to the crane mounting never exceeds a safe value.

It is known to provide means for indicating the load on a crane whereby the crane operator can act to prevent accidents or damage due to an overload. It is also known to provide means responsive to an overload for interrupting the drive to a hoisting mechanism. However, neither of these known means provides adequate safety for personnel working on offshore rigs where an overload on a crane can occur rapidly and unexpectedly due to bad sea conditions.

The present invention solves this problem by incorporating, in the derricking system of the crane, a preloaded ram which reacts against an initial overload to allow luffing of the jib, and which is arranged to actuate a release mechanism for the hoist winch when a predetermined maximum overload is exceeded so that the hoist cable runs off the hoist winch and parts at a link to unleash the load.

In the preferred embodiment of the invention, the crane comprises a hoist winch having a barrel on which a hoist cable is stored, said cable being connected to the barrel by a link, known per se, which parts at a predetermined tension. The hoist cable is normally stored on the barrel and is connected to a hook for hoisting a load. A derricking system comprises a derricking cable which connects the jib to a derricking winch for luffing the jib. The derricking system also includes an hydraulic ram connected to one or more preloaded hydropneumatic accumulators, the ram and the accumulators preferably being pivotally mounted as an assembly at the apex of the superstructure of the crane. Such an assembly is preferably supported by a further hydraulic ram connected to a hydropneumatic accumulator to provide spring support effective at any angle of the jib. The gas pressure in the accumulators is set to cause the ram to react against an initial overload to enable luffing of the jib. If the overload exceeds a predetermined maximum value, the jib will move the ram to an extent to actuate a release mechanism on the hoist winch so that the hoist cable is paid out and eventually parts from the hoist winch due to the link.

Preferably, restrictors are included in an hydraulic circuit between said accumulators and said ram for damping luffing movement of the jib, particularly when the load parts from the hoist winch.

The hoist winch may be a whip hoist winch with a respective barrel and hoist cable, which cable is reeved over the jib in a single fall to the hook. Alternatively, or in addition, the crane includes a main hoist winch connected by a cable to an anchor winch, said cable having multi-fall reeving to the hook. The barrel of the anchor winch is lighter than the barrel of the main hoist winch and it rotates freely at high speed when released. Respective cable parting links connect the barrels of the whip hoist and anchor winches to the main hoist cable. The whip hoist winch and the anchor winch may be locked or released by devices operated by respective slave actuators in circuit with a master servo-actuator which is actuated by movement of the ram. Preferably, the whip hoist winch is normally driven by an hydraulic motor, its slave actuators respectively releasing a brake on the winch barrel and operating a valve for short circuiting the hydraulic circuit to the motor to release the whip hoist winch. Preferably, the piston in each slave actuator remains at the end of its stroke, when moved by the master servo-mechanism, in a winch release position. This ensures that the hoist winch or winches are maintained in a release position for continually paying out the hoist cable.

Preferably, said link comprises a tail cable having a cross section smaller than the hoist cable and connected between the barrel of the hoist winch and the hoist cable. The tail cable snaps when the hoist cable is fully paid out from the respective winch. Preferably, the tail cable is stored in an annular recess in the barrel of the hoist winch, the hoist cable, of larger cross section, being wound over the turns of the tail cable.

In the application of the preferred embodiment of the invention to an offshore rig, the derricking cable of the crane is paid out in response to an initial jib overload and is hauled in again when the overload decreases. As the jib will generally be at a low angle to the horizontal when operating over supply vessels, paying out of the derricking cable will result in lowering of the hook. If the hook is caught in a vessel which descends into the trough of a wave, sufficient cable is paid out by the derricking system so that the bending or overturning moment in the crane mounting does not exceed a safe value, and so that the cable is recovered when the vessel rises. If the jib travels beyond a predetermined limit, due to continuing pull on the hook, (for example, when the hook is caught in a vessel which is making off), the anchor winch and whip hoist winch of the main hoist system are released to allow the main hoist cable to be unwound against a light residual tension eventually leading to parting of the tail cables. The invention ensures that the bending moments transmitted to the crane mounting, which may be a slewing ring attached to a pedestal on an offshore rig or platform, never exceeds a safe value under accident conditions. The invention also enables the dynamic characteristics of the crane to be modified so as to attenuate shock loads on the hook and thus to reduce the resulting bending moments transmitted to the crane mounting under typical offshore operation in heavy seas.

Figure 2:
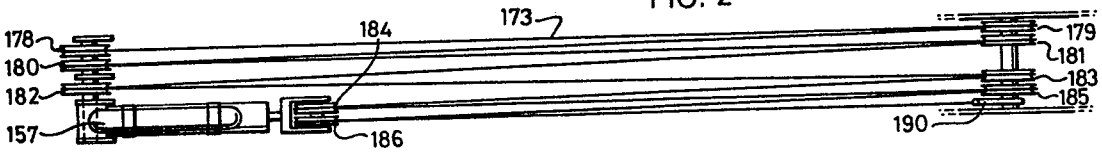
Figure 3:
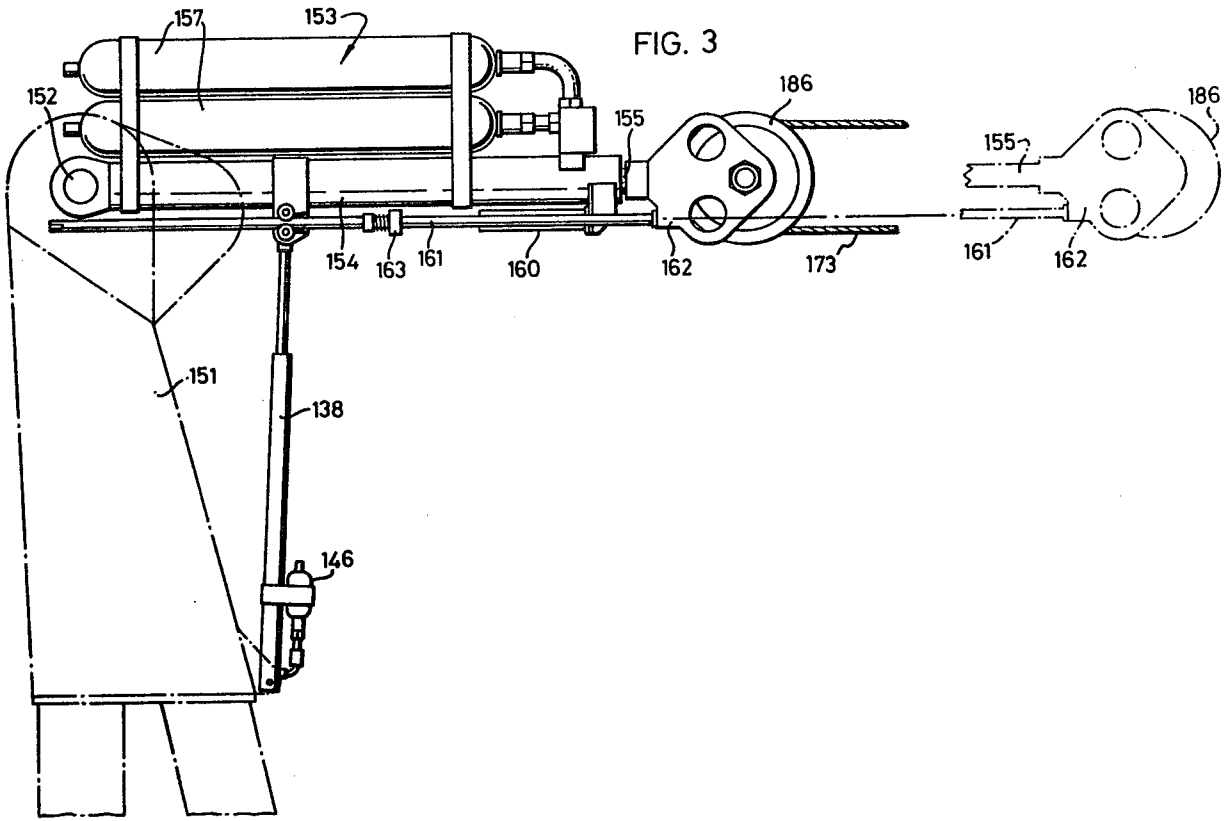
Figure 4:
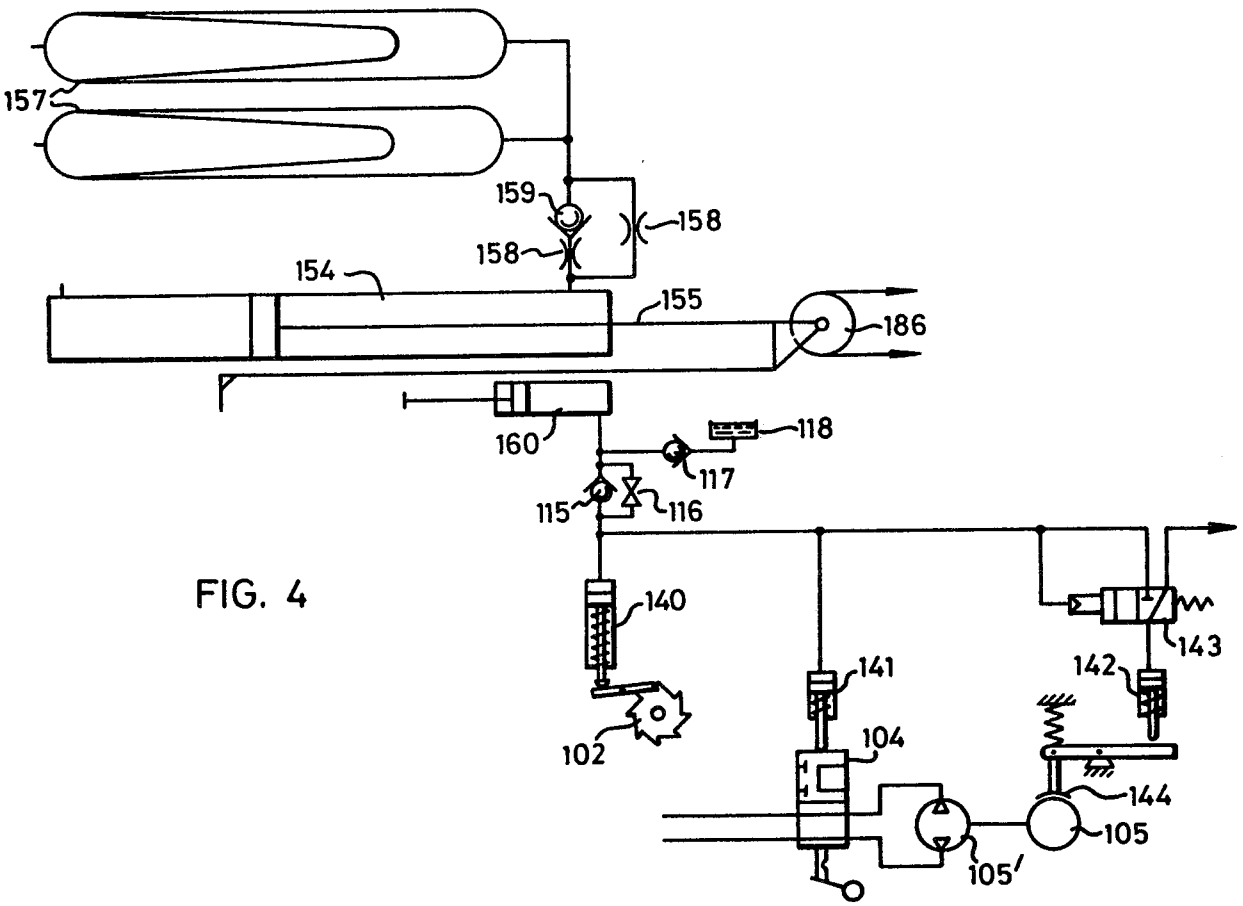
Figure 5:
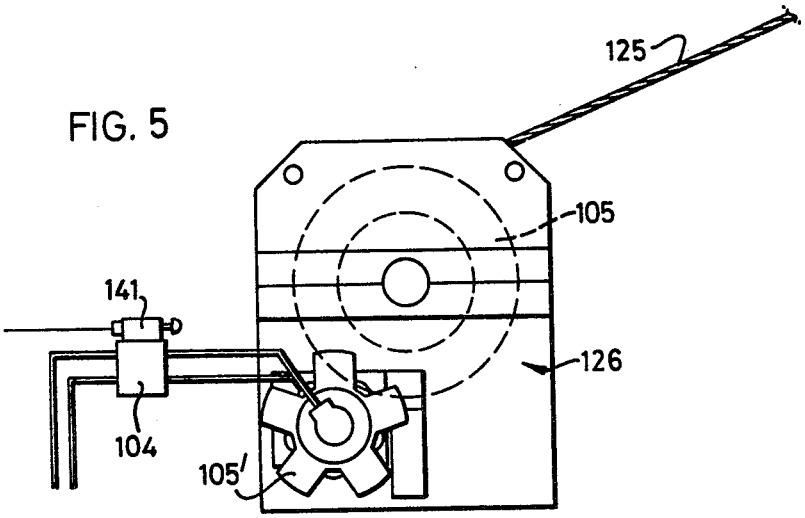
Figure 6:
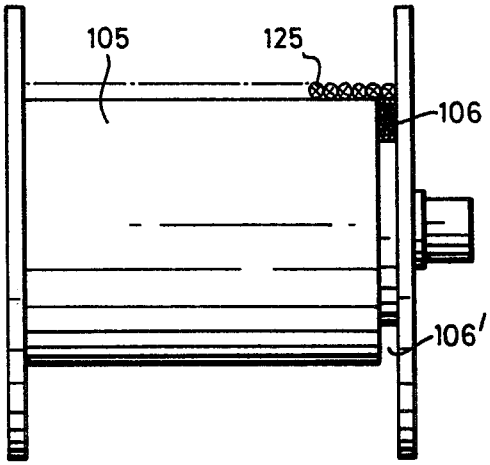
Figure 7:
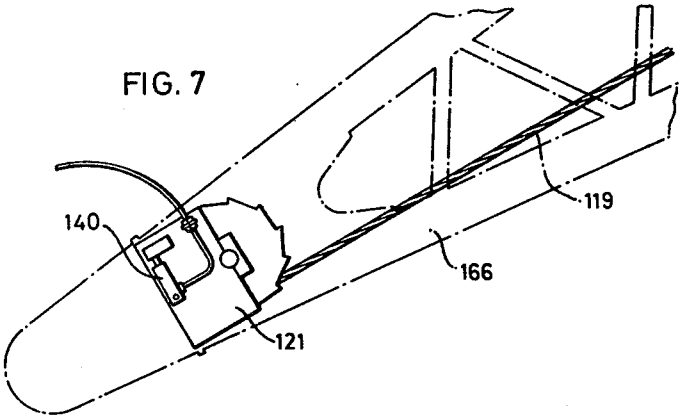
Figure 8:
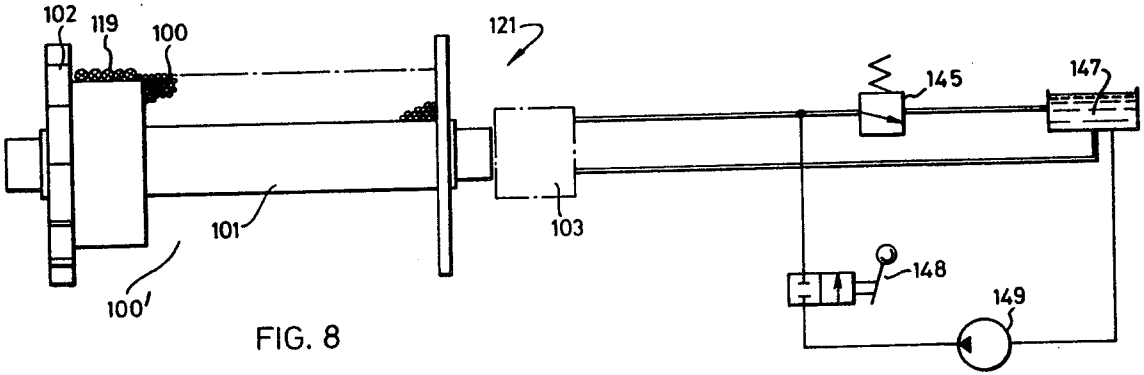

The preferred embodiment of the invention will now be described with reference to the accompanying drawings, in which:

FIG. 1 illustrates a crane including the parts shown in subsequent drawings, FIG. 2 is a plan view of the crane shown in FIG. 1, FIG. 3 is an elevational view of a unit mounted at the apex of the superstructure of the crane, FIG. 4 is a schematic view of an hydraulic circuit of the unit shown in FIG. 3, FIGS. 5 and 6 respectively illustrate a whip hoist and a whip hoist winch, and FIGS. 7 and 8 respectively illustrate a main hoist anchor winch mounted at the foot of the jib and the same winch connected to an hydraulic system.

Referring to FIG. 1, a crane is mounted on top of a fixed pedestal 164 by means of a slew ring bearing 165 allowing rotation about a vertical axis. Jib 166 is pin connected to a bedframe 167 on which is mounted superstructure 151. A main hoist hook block 160 is supported by multi-fall reeving of hoist cable 119. One end of cable 119 is wound on a barrel of a main hoist winch 120, the other end being anchored and wound on an anchor winch 121. A whip hoist hook 174 is supported by a single fall of cable 125 wound on the barrel of a whip hoist winch 126. The main hoist cable of winches 121 and 126 are connected to respective barrels by parting links in the form of tail cables, as explained below.

As shown in FIGS. 1–3, a pin connected assembly 153 is mounted at the apex of the superstructure 151 on the same shaft 152 which supports fixed return pulleys 178, 180, 182 for the multi-fall reeving of derricking cable 173. Assembly 153 comprises an hydraulic ram 154 having a rod 155 on the free end of which are mounted one or more return pulleys 184, 186 of the jib derricking system. Mounted on the ram 154 and connected to it in the manner shown in FIG. 4 are parallel connected hydropneumatic accumulators 157. Accumulators 157 are preloaded with compressed gas so that the ram 154 is held retracted until the derricking load exceeds a value corresponding to the gas preload. Restrictors 158 and a non-return valve 159 are provided in the hydraulic circuit to give the required damping characteristics in both directions of luffing of the jib. The gas "spring rate" of the ram and accumulator assembly is chosen so as to give a rising load/deflection characteristic which (a) with the damping in the circuit, results in a satisfactory dynamic load attenuation in the crane structures and (b) does not lead to dangerous stresses in the crane structure on full stroke of the ram. Movement of the ram 154 causes the pulleys 184,186 to move towards the jib head which causes the derricking cable 173 to be paid out thus allowing the jib to luff. The accumulators 157 cause the ram 154 to react, through the derricking cable 173, against the bending moment about jib foot 172 (due to the weight of the jib), and against the major part of the bending moment due to a load on either of the hook blocks 160,174. The load in the derricking cable 173 is an approximate indication of the total overturning moment transmitted to the pedestal 164. This is the reason for using movement of the ram 154 to actuate release of winches 126 and 121 as explained later in this description. As best shown in FIG. 2, the derricking cable 173 is reeved over pulleys 178, 180, 182 at the apex of superstructure 151; over pulleys 184, 186 mounted in the bracket 162 attached to the ram rod 155, and over pulleys 179, 181, 183, 185 mounted at the head of the jib 166. The derricking cable 173 extends from derricking winch 177 and is reeved about the latter pulleys before being attached to anchor 190 at the jib head.

As shown in FIGS. 3 and 4, an hydraulic master servo-actuator 160 is mounted on the ram 154 and is connected to one or more slave actuators 140, 141, 142 for respectively releasing a ratchet 102, an hydraulic motor 105', and a brake 144 which is normally spring applied to the barrel 105. The ratchet 102 and the brake 144 are usually applied so as to prevent rotation of the whip hoist winch 126 and the anchor winch 121. A shuttle valve 143 is usually in the position shown so that fluid can be pumped into or out of slave actuator 142, by (known) remote control from the crane cabin, to release the brake 144 when the whip hoist winch is used. The (known) remote control generally includes a source of hydraulic fluid under pressure which is selectively connected by a control valve to the shuttle valve 143 when the crane operator wishes to use the whip hoist winch. The connection to the remote control is indicated by the arrow in FIG. 4. However, the shuttle valve 143 is also moved automatically by fluid pumped from the master actuator 160 to the slave actuator 142. The master actuator 160 can only be operated when the ram rod 155 approaches the end of its stroke. As shown in FIG. 3, a pair of pull rods 161 are connected to the pulley bracket 162 and are mounted on the rod 155. A striker 163 is mounted between the pull rods 161 for contacting and depressing the piston of the master actuator 160. The master actuator 160 is connected to a reservoir 118 via a non-return valve 117 and to the slave actuators via a non-return valve 115 and short-circuiting valve 116.

The weight of the assembly 153 is supported by a hydraulic ram 138 connected to an hydropneumatic accumulator 146 to provide a spring support which is effective at any angle of the jib 166.

Referring to FIGS. 5 and 6, in order to ensure eventual clean separation of the whip hoist cable 125 from the crane in the event of a continuous pull after release of the whip hoist winch 126, the anchor end of the whip hoist cable is connected to a light tail cable 106 which is wound on barrel 105. The tail cable 106 is long enough to enable the main whip hoist cable 125 to be run out clear of the crane before the anchorage of the tail cable 106 to the barrel 105 comes under tension. At this point, either the light tail cable 105 breaks, or the connector between this and the main cable breaks. In either case, damage to the crane by entanglement of the hoist cable is avoided.

In the case of the main hoist system with multi-fall reeving to hook 160, rapid pull out of the hook after release would result in very high speeds at the main hoist winch 120. The inertia and drag of the main hoist winch 120 could lead to excessive forces to pull out the cable. Therefore, it is advantageous to release the anchor end of the main hoist cable 119 by winding it onto a light barrel, on which a light tail cable is stored, and arranging for this barrel to be released by the anchor winch 121 rather than the main hoist winch 120. As shown in FIGS. 7 and 8, the barrel of the anchor winch 121 is locked by a releasable ratchet 102 which is released by slave actuator 140. It also has connected to it a small hydraulic motor 103 for rewinding the tail cable 100. This motor acts as a pump when the barrel is released to pump oil through a relief valve 145 to a reservoir 147 to provide a light tension in the tail cable to prevent it from going slack when being rapidly unwound. The rewind circuit includes a control valve 148 and a pump 149.

FIGS. 5 and 6 respectively show the whip hoist winch 126 and whip hoist barrel 105 wherein a main whip hoist cable 125 is connected to a tail cable 106 as in the case of the anchor winch 121. As shown in FIGS. 6 and 8, the tail cables 100, 106 are stored in annular recesses 100', 106' on the respective barrels and a plurality of dead turns of the main cable are wound over the stored tail cable. The whip hoist winch 126 is released by opening a short circuit valve 104 by a slave actuator 141 and by releasing brake 144 with slave actuator 142 to allow free rotation of the hydraulic motor 105' driving the barrel 105.

The invention is defined by the following claims.

What is claimed is:

1. In a crane having a superstructure and comprising at least one hoist winch having a barrel on which a hoist cable is stored, said hoist cable being connected to the barrel of the hoist winch by link means which parts at a predetermined tension, a jib over which said cable is reeved for connection to a load, and a derricking system including a derricking winch and pivotally mounted pulley means, a derricking cable winch is reeved over the derricking winch, the pulley means and the jib for luffing the jib, the improvement wherein the derricking system comprises hydraulic ram means and preloaded hydropneumatic accumulator means connected to said hydraulic ram means, said ram means and said accumulator means being mounted on said crane superstructure, said ram means having rod means connected to said pulley means for pivoting said pulley means, the gas pressure in said accumulator means being set to cause said ram means to react against a predetermined overload in said derricking system, and including release means for said hoist winch, said release means being responsive to movement of said ram means due to exceeding said predetermined overload whereby said hoist winch, when released, pays out said hoist cable to enable parting of said link means.

2. The improvement according to claim 1 wherein said ram means are pivotally mounted as an assembly at the apex of the superstructure of the crane, said assembly being supported by further hydraulic ram means connected to another hydropneumatic accumulator means to provide spring support effective at any angle of the jib.

3. The improvement according to claim 2 wherein said accumulator means connected to said ram means are so connected by restrictors for damping the luffing movement of the jib.

4. The improvement according to claim 3 wherein the crane has a whip hoist winch and a main hoist system including an anchor winch and a hoist winch, said release means comprising an hydraulic master servo-actuator in circuit with respective slave actuators for operating locking and releasing devices connected to said whip hoist winch and said anchor winch.

5. The improvement according to claim 4 wherein said whip hoist winch is normally driven by an hydraulic motor and slave actuators are provided for respectively operating valve means for short-circuiting the hydraulic circuit to the motor and a spring assisted brake to release said whip hoist winch.

6. The improvement according to claim 5 wherein said link means is a tail cable connected between the barrel and hoist cable of the respective winch, said tail cable being stored in an annular recess in the barrel of the winch.

* * * * *